United States Patent [19]

Bohnengel

[11] 4,288,043

[45] Sep. 8, 1981

[54] MEASURING TAPE DISPENSER

[75] Inventor: Andrew C. Bohnengel, Sylvania, Ohio

[73] Assignee: The Perfect Measuring Tape Company, Toledo, Ohio

[21] Appl. No.: 141,355

[22] Filed: Apr. 18, 1980

[51] Int. Cl.[3] ..... B65H 75/02

[52] U.S. Cl. ..... 242/55; 33/128; 242/158 R

[58] Field of Search ..... 242/55, 158 R; 33/128, 33/138

[56] References Cited

U.S. PATENT DOCUMENTS

| | | | |
|---|---|---|---|
| 1,790,103 | 1/1931 | La Follette | 33/138 |
| 1,886,902 | 11/1932 | Popkin | 33/128 |
| 2,425,724 | 8/1947 | Bohnengel | 242/55 |
| 3,598,337 | 8/1971 | Mackie | 242/158 R |

*Primary Examiner*—Edward J. McCarthy

*Attorney, Agent, or Firm*—Fisher, Gerhardt, Crampton & Groh

[57] ABSTRACT

A mechanism for dispensing a measuring tape into the wraps of a length of cloth that is being wound onto a mandrel has a carriage that is mounted for reciprocal movement along a guide extending transversely to the length of the cloth. The carriage has means for rotatably mounting two rolls of tape so that when one is exhausted the other quickly may be utilized and the first replaced while the second is being dispensed. The mechanism has a drive wheel which is driven by engagement with the cloth being wound, or a part of the cloth winding machine, for positively reciprocating the carriage so that the only tension of the measuring tape is that required to unwind the roll.

5 Claims, 7 Drawing Figures

FIG. 1
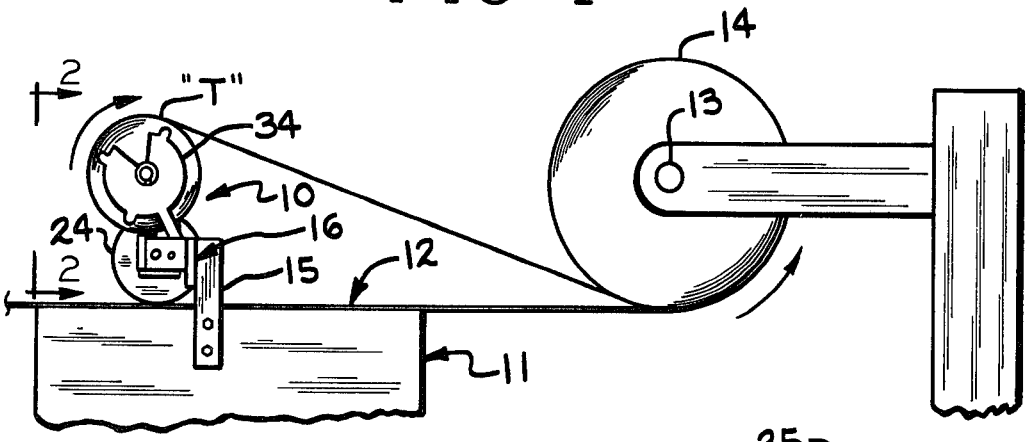
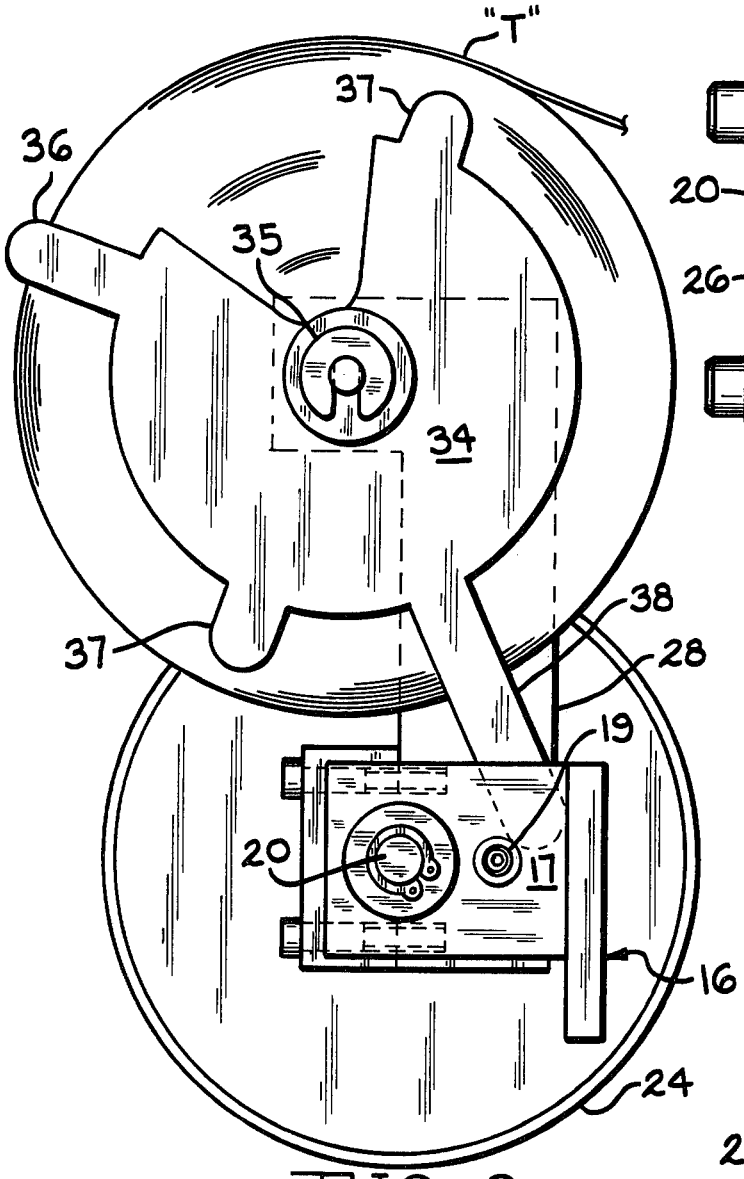
FIG. 3
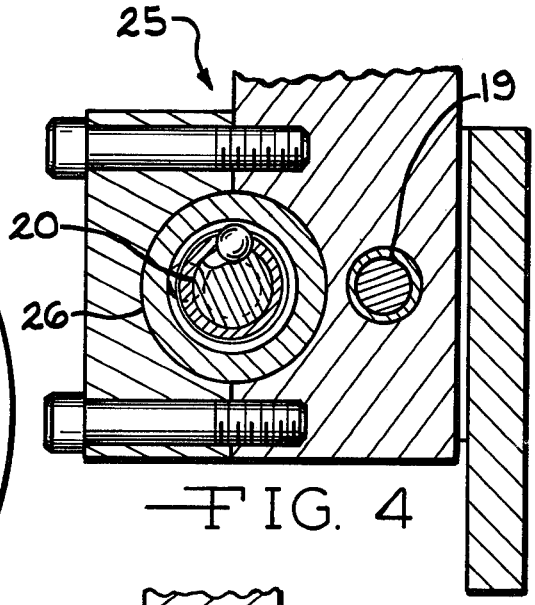
FIG. 4
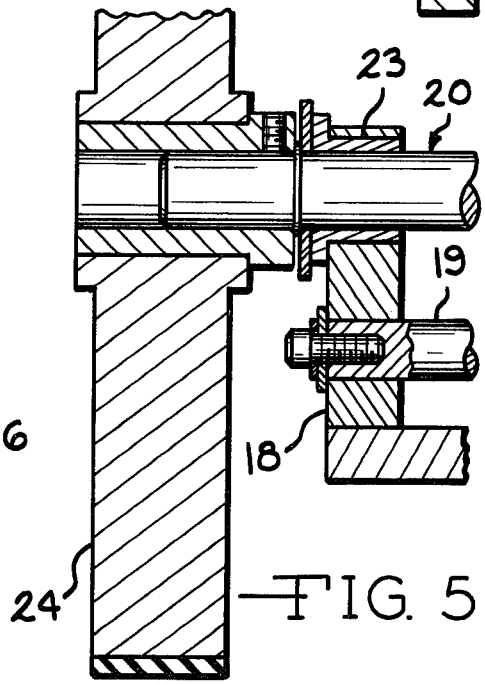
FIG. 5

MEASURING TAPE DISPENSER

BACKGROUND OF THE INVENTION

Bohnengel U.S. Pat. No. 2,425,724 discloses a device for feeding a measuring tape between the wraps of a length of fabric being wound upon a mandrel to form a bolt. Such a measuring tape usually in accurately marked in yards and serves two functions. First, by feeding the tape into the fabric as it is wound upon itself a very accurate measurement of the length of the fabric on the bolt is provided by the tape. Secondly, when some of the fabric is removed from the bolt the measuring tape provides an indication of the number of yards still remaining in the bolt and thus gives a quick inventory indication. Such measuring or indicating tapes usually are fabricated from paper in order that they shall be light weight and not pile up and usually are wound into both industrial bolts, which may average 100 yards or so in length, and into retail bolts of lesser lengths.

The Bohnengel patent discloses a device comprising a carriage which is moveable in one direction transversely to the length of the fabric being wound upon itself in order to dispense the tape in a helical path which actually constitutes the hypotenuse of a right triangle, the base of which is defined by the distance of movement of the carriage and the other side of which is the length of the fabric indicated by the length of tape dispensed from the carriage during its movement.

The carriage of the mentioned Bohnengel patent mounts a roll of measuring tape and includes a wheel over which the tape is led on route to the nip between the wraps of the fabric. The tension applied to the tape by its being interwound with the fabric rotates the wheel. The wheel is engaged with a stationary threaded shaft so that as the wheel rotates the carriage is moved along the threaded shaft and the tape is traversed by the carriage so that it winds into the bolt of fabric in the helix in order to eliminate the pile up which would result if the tape were fed from a stationary carriage. When the carriage has been moved to the end of the threaded shaft it is necessary to stop the machine, to disengage the wheel from the threaded shaft and to move the carriage back to the starting point.

A major draw back in this structure resides in the fact that tension applied to the tape itself is utilized to rotate the wheel relative to the threaded shaft in order to achieve transverse movement of the carriage and the tape supply roll. Therefore, because tapes utilized for this purpose are made of thin paper, this tension often snaps the tape. It then is necessary to unwrap the partially wound bolt of cloth in order to remove the length of measuring tape already wound in. The carriage then must be moved back to the starting position on the threaded shaft and a new roll of measuring tape mounted. The winding of the bolt then is recommended from the beginning.

In addition, in the apparatus of this U.S. Pat. No. 2,425,724, it is necessary to stop the apparatus in order to replace an exhausted reel of measuring tape with a new supply.

It is, therefore, the principal object of the instant invention to provide a mechanism for dispensing a measuring tape into the wraps of a length of cloth being wound upon a mandrel which can mount two rolls of measuring tape so that as one is exhausted, the second quickly may be utilized and the exhausted tape replaced by a new roll of tape while the second roll is being dispensed.

It is another object of the instant invention to provide a mechanism for dispensing a measuring tape into the wraps of a bolt of cloth wherein the force for traversing or reciprocating the roll(s) of measuring tape back and forth across the width of fabric being wound is provided by a drive wheel directly engaged either with the fabric or with a part of the fabric winding machine so that the only tension on the measuring tape itself is that required merely to unwind it.

Yet another object of the invention is to provide for automatic reciprocation back and forth of the tape roll mounting carriage thus eliminating the necessity for stopping the machine to return the carriage at the end of each traverse across the fabric.

BRIEF DESCRIPTION OF THE DRAWINGS

FIG. 1 is a side view in elevation showing a mechanism for embodying the invention in position for dispensing a measuring tape into the wraps of a bolt of cloth;

FIG. 3 is a side view at an enlarged scale of a portion of the mechanism in FIG. 1;

FIG. 4 is a fragmentary, vertical sectional view taken along line 4—4 of FIG. 2;

FIG. 5 is a fragmentary, horizontal sectional view taken along line 5—5 of FIG. 2;

DESCRIPTION OF PREFERRED EMBODIMENT

Figure 2:
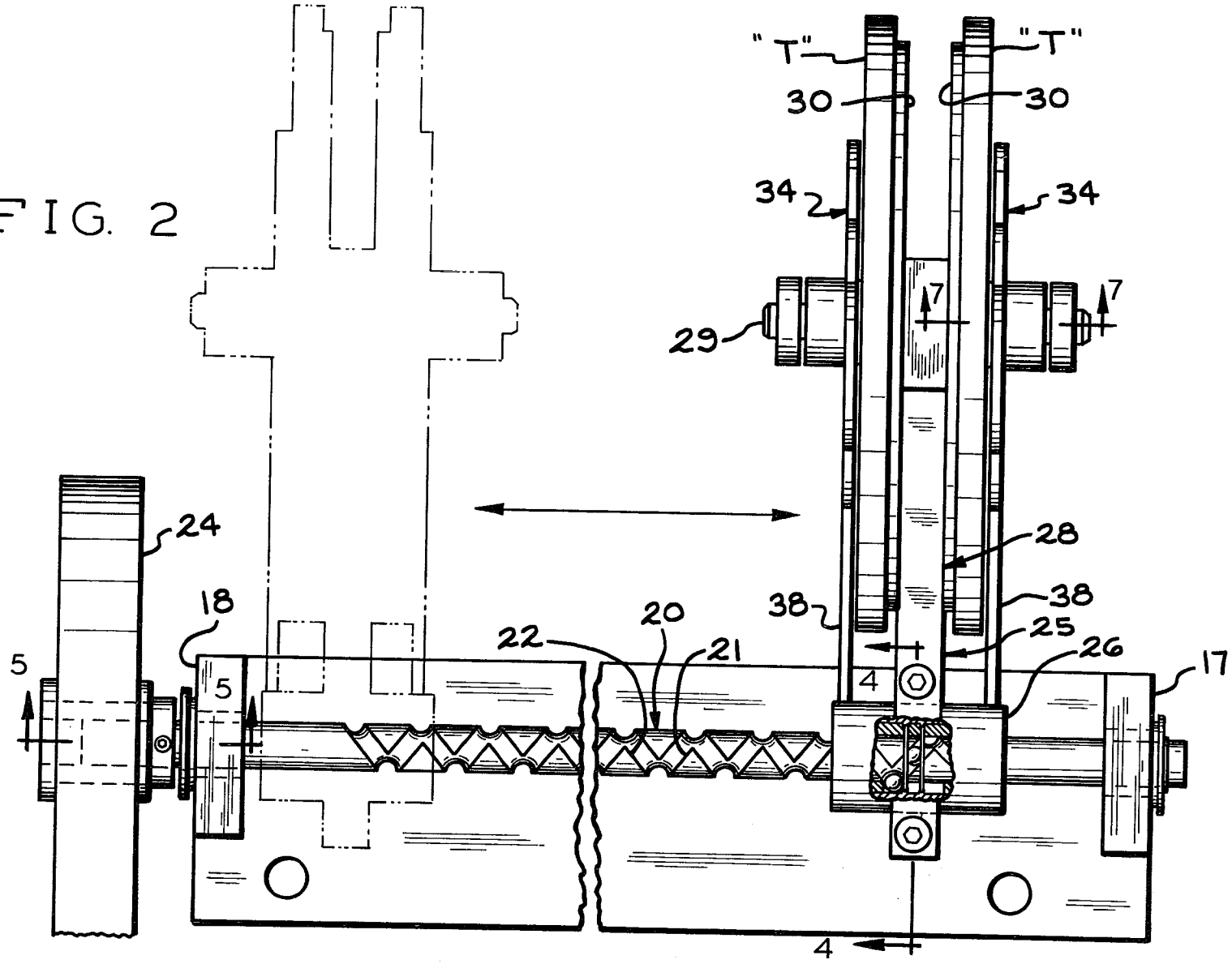
FIG. 2 is a greatly enlarged view in elevation, with parts broken away, taken from the position indicated by line 2—2 of FIG. 1.

A mechanism embodying the invention is generally indicated by the reference number 10 and is shown in FIG. 1 in one of its common positions wherein it is mounted on a cloth inspection table or winding machine 11 over which a length of cloth 12 is fed on route to a mandrel 13 which is driven by mechanism (not shown) to wind the cloth 12 onto the mandrel 13 in the form of a bolt 14 of substantial length, for example, say 100 yards. The mechanism 10 is supported in position on the table 11 by a mounting arm 15 bolted or otherwise secured at the side of the machine 11.

The mechanism 10 has a frame 16 which extends horizontally a short distance, say ten inches or so, across and above the length of cloth 12. The frame 16 has a pair of end plates 17 and 18 between which there extends a guide rod 19 and a rotatable shaft 20 which has a pair of opposite band screws 21–22 in its surface. A shaft of this type is sometimes called a double-helix shaft.

The shaft 20 is rotatably mounted in the end plates 17 and 18 by suitable bushings 23 and has one exposed end upon which a drive wheel 24 is fixed.

A carrier 25 (see FIGS. 2 and 4, particularly) is mounted for sliding movement along the guide rod 19 and back and forth along the double-helix screw shaft 20 the carriage has a ball type reverser, generally indicated by the reference number 26, which comprises a pair of balls which alternately engage in the opposite hand screw 21–22 as the screw shaft 20 rotates to reciprocate the carriage back and forth across frame 16. The ball reverser 26 is a conventional apparatus and therefore will not further be described.

The carriage 25 has an arm 28 which extends radially away from the double-helix shaft 20 and mounts a double ended axle 29 (see FIG. 6) near its outer end. The axle 29 is fixed in the arm 28 so that it does not rotate. A generally circular inner plate 30 is positioned on each side of the arm 28 and held against rotation by a screw 31 threaded through the plate 30 and into a tapped hole 31*a* (FIG. 7) in a part of the arm 28.

Figure 6:
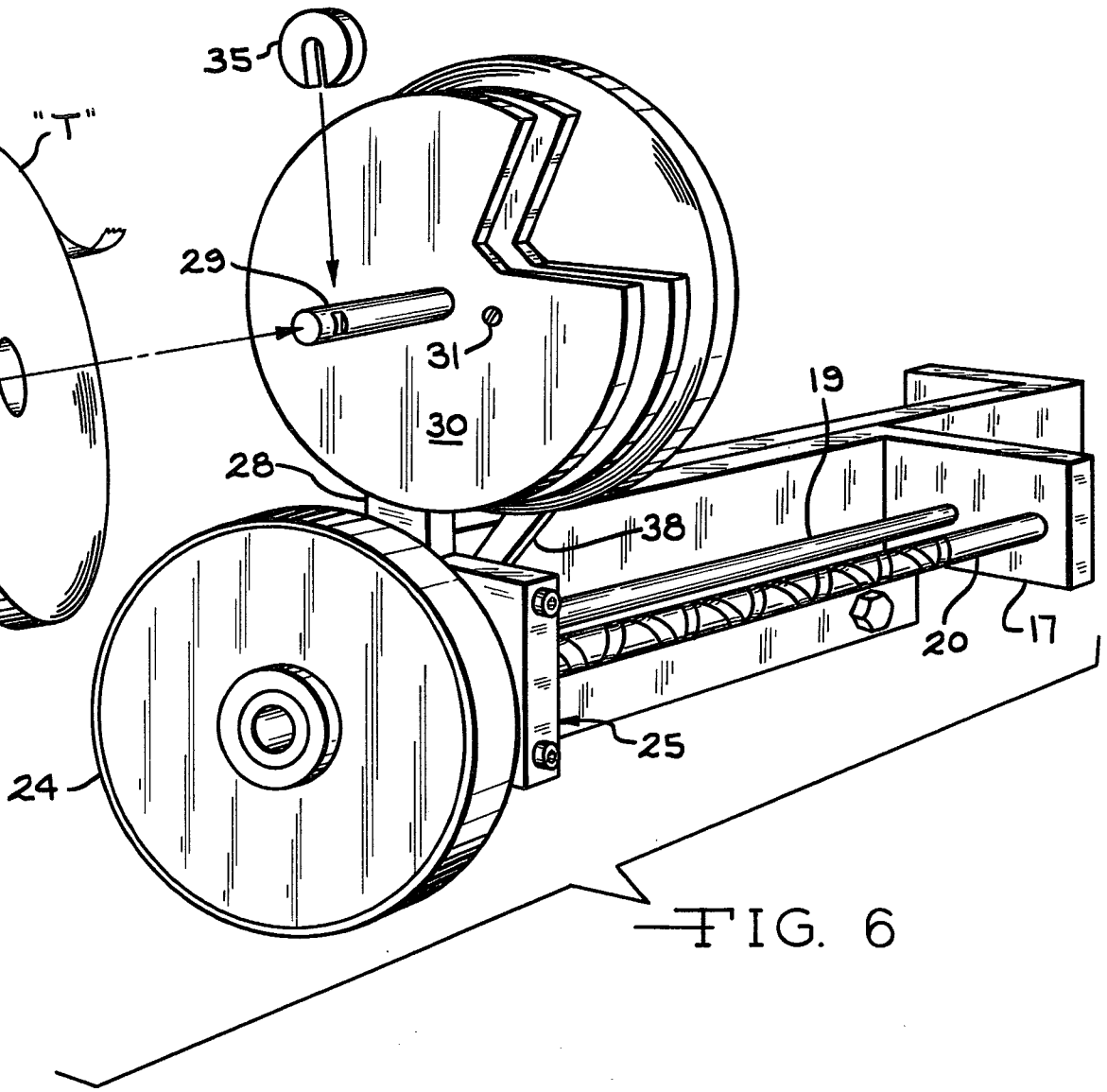
FIG. 6 is an enlarged view in perspective taken from the end of the mechanism opposite to that shown in FIG. 3.
Figure 7:
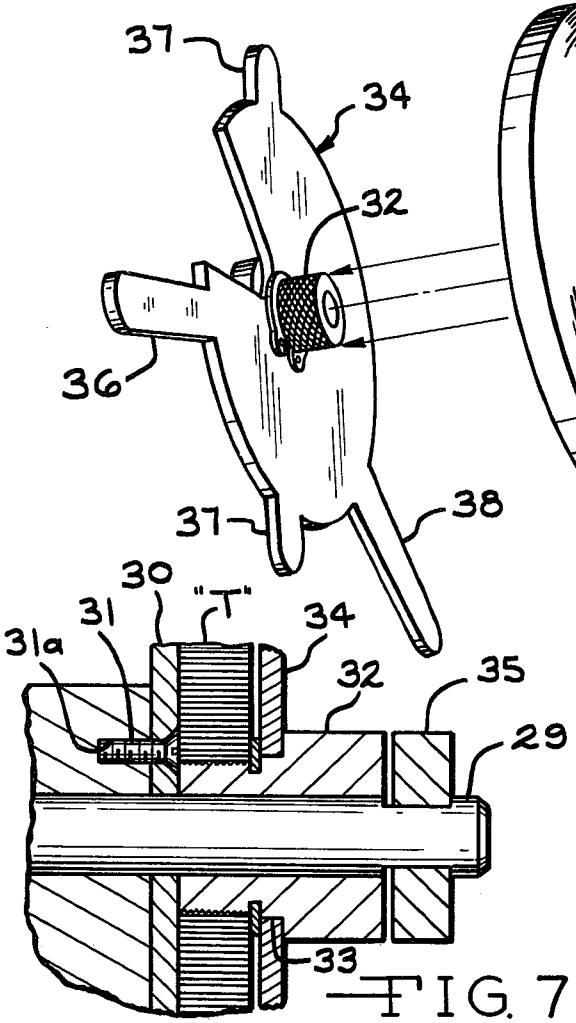
FIG. 7 is a fragmentary, sectional view taken along line 7—7 of FIG. 2.

As best can be seen by reference to FIGS. 2, 6 and 7, a tape roll bushing 32 is rotatably mounted in a central bore 33 of each of two outer plates 34 and the bushings 32 are of such size as to be freely rotatable on the axle 29.

A roll of measuring tape "T" is placed on the inner, knurled end of a a bushing 32 and the outer plate 34 with the roll of tape is then slid onto the axle 29 thereby mounting the roll of tape freely rotatably upon the axle 29 between the inner plate 30 and the outer plate 34. The outer plate 34 and the roll of tape are retained in place on the axle 29 by a C-clip 35.

Each of the outer plates 34 has several arms 36, 37 and 38, the arm 38 being considerably longer than the arms 36 and 37 and, in proper mounting position, extending downwardly into the space between the main frame member 16 and the guide rod 19, as is most clearly shown in FIG. 3, to prevent rotation of the outer plate 34 as the roll of tape is unwound. The slight friction between the inner side of the outer plate 34 and the roll of tape being unwound provides a minimal drag on the roll of tape in order to prevent undesirable unwinding of the tape if the cloth rolling machine is suddenly slowed or stopped.

When the mechanism is in use and a length of measuring tape is being unwound and fed between the wraps of cloth being wound into a bolt, the only tension on the tape is that required simply to rotate it and the bushing 32 on the axle 29. Because of the simplicity of removal of the outer plates 34, when one of the rolls of tape is exhausted, the second roll immediately may be utilized for continuing interfeeding into the bolt of cloth while a new roll of tape is placed on the opposite side of the axle 29 in the manner indicated.

While the mechanism embodying the invention is shown in position where its drive wheel 24 engages the actual cloth being wound on the mandrel 13 it will be appreciated that in some installations it may be desirable to mount the entire mechanism 10 in a position where the drive wheel 24 engages a rotary shaft, such as a tensioning roller, in the fabric handling mechanism rather than the fabric itself. In either case, of course, the positive drive which reciprocates the carriage 25 back and forth to feed the tape helically between the wraps or layers of the bolt 14 does not place any substantial tension upon the tape, thereby virtually eliminating tape breakage.

Having described my invention I claim:

1. Mechanism for dispensing measuring tape into the wraps of a length of cloth that is being wound onto a mandrel, said mechanism comprising, in combination, (a) a frame extending transversely to the length of the cloth, (b) a horizontally extending guide on said frame, (c) a carriage mounted for movement along said guide, (d) a rotatable shaft mounted on said frame for reciprocating said carriage back and forth along said guide, (e) means on said carriage engaged with said shaft, (f) an arm on said carriage which extends radially away from said shaft, (g) means on the outer end of said arm for individually replaceably mounting each of two rolls of measuring tape, and (h) a drive wheel fixed on the end of said shaft to rotate the latter in response to movement of a length of cloth being wound.

2. A mechanism according to claim 1 in which the shaft has a pair of opposite hand screws in its surface and which is mounted for rotation on said frame with its axis parallel to the axis of said guide, and in which the carriage has means which alternately engage the opposite hand screws on said shaft for reciprocating said carriage on said guide.

3. A mechanism according to claim 1 in which the means for mounting the rolls of measuring tape on the outer end of the arm comprise a pair of spaced non-rotatable plates for each of the rolls of measuring tape and between which plates the roll is mounted.

4. A mechanism according to claim 3 in which the pairs of plates are mounted co-axially and the outer one of said plates of each pair is removable for mounting a new roll of tape when a previous roll is exhausted.

5. Mechanism for dispensing measuring tape into the wraps of a length of cloth that is being wound onto a mandrel, said mechanism comprising, in combination, (a) a horizontally extending frame, (b) a guide extending horizontally across said frame, (c) a shaft which has a pair of opposite hand screws in its surface and which is mounted for rotation on said frame with its axis parallel to the axis of said guide, (d) a carriage mounted for horizontal movement along said guide and said shaft, (e) means on said carriage engaged with the screws on said shaft, (f) an arm on said carriage which extends radially away from said shaft, (g) a double-ended axle mounted on the outer end of said arm and extending parallel to said shaft, (h) a generally circular inner plate mounted on each side of said axle and secured against rotation thereon, (i) an outer plate removably mountable on each end of said axle, said inner and outer plates providing for the freely rotatable mounting of a roll of measuring tape therebetween, and (j) a drive wheel fixed on the end of the said shaft to rotate the latter in response to movement of a length of cloth being wound.

* * * * *

UNITED STATES PATENT AND TRADEMARK OFFICE

CERTIFICATE OF CORRECTION

PATENT NO. : 4,288,043

DATED : September 8, 1981

INVENTOR(S) : Andrew C. Bohnengel

It is certified that error appears in the above—identified patent and that said Letters Patent is hereby corrected as shown below:

Column 1, line 57, "recommended" should read --recommenced--

Column 2, line 56, "band" should read --hand--

Signed and Sealed this

*Twenty-third* Day of *February 1982*

[SEAL]

*Attest:*

GERALD J. MOSSINGHOFF

*Attesting Officer*

*Commissioner of Patents and Trademarks*